US007931179B1

(12) United States Patent
Cuellar

(10) Patent No.: US 7,931,179 B1
(45) Date of Patent: Apr. 26, 2011

(54) HOLDER FOR WALL AND CEILING COMPOUND FINISHING ACCESSORIES FOR DRYWALL

(76) Inventor: Juan Carlos Cuellar, Lynchburg, VA (US)

( * ) Notice: Subject to any disclaimer, the term of this patent is extended or adjusted under 35 U.S.C. 154(b) by 523 days.

(21) Appl. No.: 12/055,405

(22) Filed: Mar. 26, 2008

(51) Int. Cl.

| | |
|---|---|
| ***A45C 15/00*** | (2006.01) |
| ***A45F 4/00*** | (2006.01) |
| ***A45F 5/00*** | (2006.01) |
| ***B65D 21/00*** | (2006.01) |
| ***A47F 7/00*** | (2006.01) |

(52) U.S. Cl. ..... 224/661; 224/576; 224/577; 224/183; 224/584; 206/503; 211/70.6

(58) Field of Classification Search ..... 224/661, 224/576, 183, 577, 584, 904; 206/373, 503, 206/504, 505, 506, 507, 508, 509, 510, 511, 206/512, 513; 211/70.6

See application file for complete search history.

(56) References Cited

U.S. PATENT DOCUMENTS

| | | | | |
|---|---|---|---|---|
| 4,282,975 | A * | 8/1981 | Ovadia | 206/566 |
| 5,358,161 | A * | 10/1994 | Perugini | 224/666 |
| 6,043,914 | A * | 3/2000 | Cook et al. | 398/1 |
| 6,049,914 | A * | 4/2000 | Heilman | 2/247 |
| 6,402,002 | B1 * | 6/2002 | Benton | 224/600 |
| 6,435,389 | B1 * | 8/2002 | Sucher | 224/576 |
| 6,675,965 | B2 * | 1/2004 | Holland et al. | 206/338 |
| 7,392,921 | B1 * | 7/2008 | McKenzie | 224/666 |
| 2002/0070137 | A1 * | 6/2002 | Hedges | 206/373 |

* cited by examiner

*Primary Examiner* — Nathan J Newhouse
*Assistant Examiner* — Lester L Vanterpool
(74) *Attorney, Agent, or Firm* — Sanchelima & Associates, P.A.

(57) ABSTRACT

A holder for compound tray and tools that includes a flexible sheet assembly that is removably mounted to a belt positioned around a user's waist. The sheet assembly includes a number of pockets with magnets designed for holding tools inside. Reinforcement members are mounted to the upper and lower edges of the sheet assembly to hold the sheet assembly in an extended position yet there are no reinforcement members along the lateral edges to still permit some flexibility of the sheet assembly. A tray holder assembly is mounted to the reinforcement adjacent to the lower edge. A tray holder supporting assembly, like cords, keeps the tray holder in a substantially horizontal position. Magnetic elements that are mounted to the tray and tray holder cause the tray to come toward the tray holder providing stability to the structure. Locking members can also be removably mounted to the tray and tray holder assembly to keep them together.

14 Claims, 4 Drawing Sheets

HOLDER FOR WALL AND CEILING COMPOUND FINISHING ACCESSORIES FOR DRYWALL

BACKGROUND OF THE INVENTION

1. Field of the Invention

The present invention relates to a holder for wall and ceiling compound finishing accessories for drywall.

2. Description of the Related Art

Several designs for holding tools have been designed in the past. None of them, however, includes an ergonometrically compatible holder for wall and ceiling compound finishing accessories.

The present invention permits a user to carry and use the tools that are needed for compound finishing work.

SUMMARY OF THE INVENTION

It is one of the main objects of the present invention to provide a holder for compound, tray, and tools that permits a user to readily use the compound and tools without requiring the use of a user's hand to hold them.

It is another object of this invention to provide a holder that minimally interferes with a user's movement and work.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
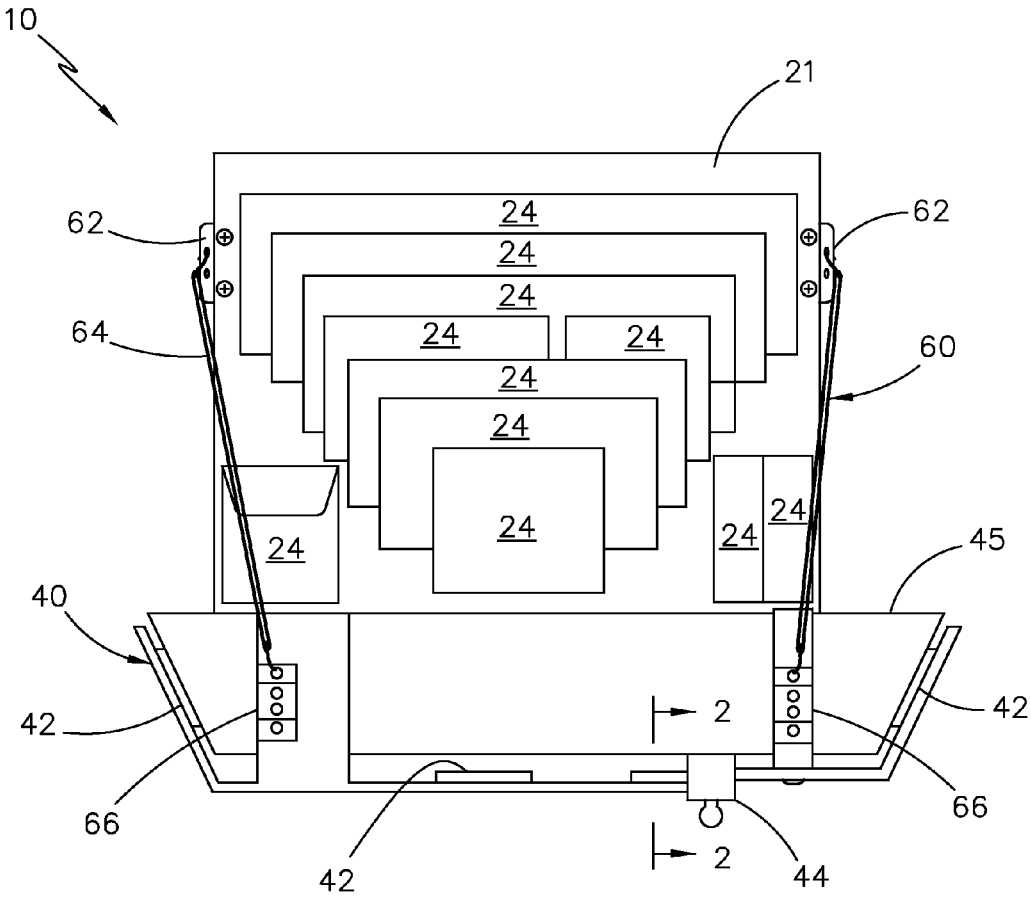
FIG. 1 represents a front elevational view of one of the preferred embodiments of the present invention.
Figure 2:
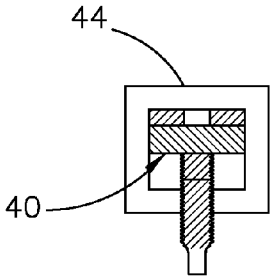
FIG. 2 shows an enlarged side elevational view of the tray holder fastener.
Figure 2A:
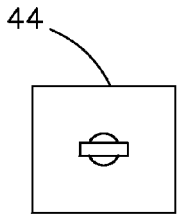
FIG. 2A illustrates the fastener shown in FIG. 2 from a bottom elevational view.
Figure 3:
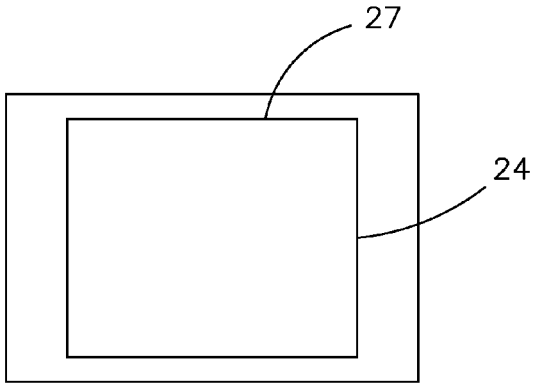
FIG. 3 is a representation of an enlarged elevational view of the inside of a pocket lined with magnetic material.
Figure 3A:
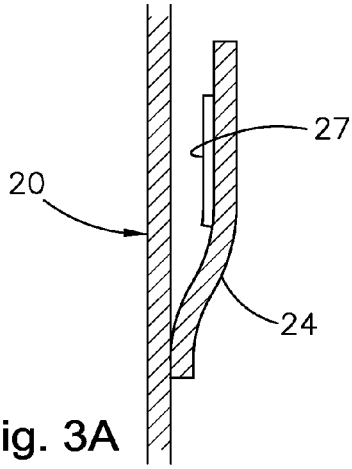
Figure 4:
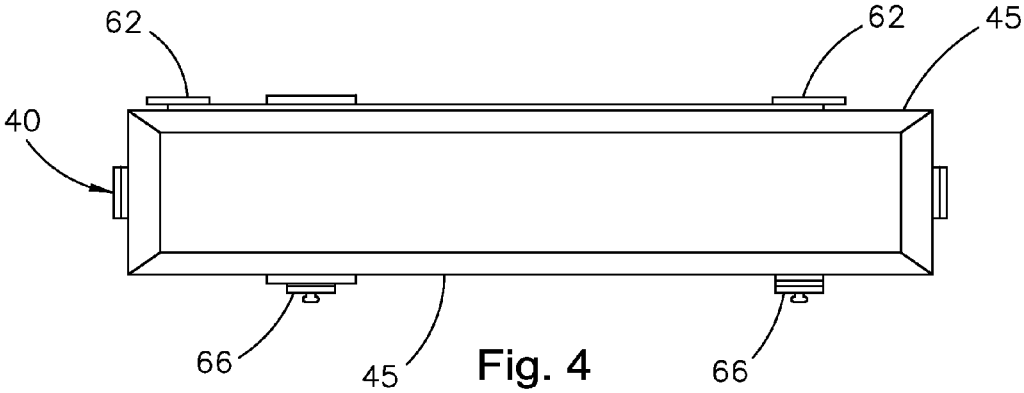
FIG. 4 is a top elevational view of the tray within the tray holder assembly.
Figure 5:
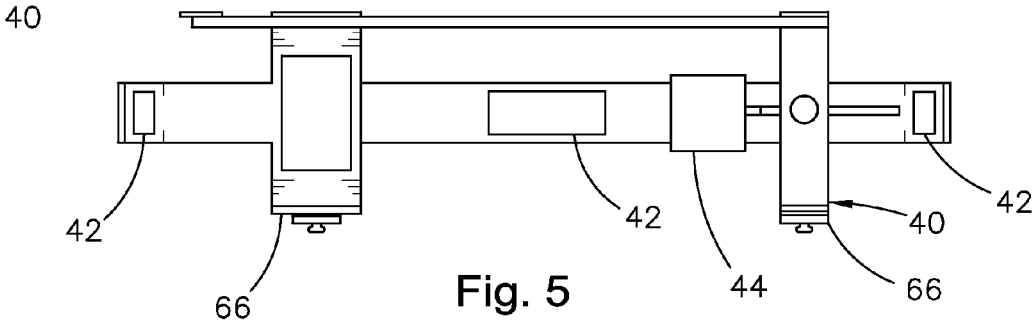
FIG. 5 is a top elevational view of the tray holder assembly shown in FIG. 4 without the tray.

Referring now to the drawings, where the present invention is generally referred to with numeral 10, it can be observed that it basically includes flexible sheet assembly 20, tray holder assembly 40, and tray holder supporting assembly 60. The functional interrelationship of these assemblies and their elements provide advantages to a user in the field of finishing drywall structures.

Flexible sheet assembly 20 has, in one of the preferred embodiments, a substantially rectangular shape with front and back sides 21 and 22, respectively, with pockets 24 that have cooperative dimensions to receive tools T of different dimensions and shapes. These tools include screwdrivers, taping knives of different widths, etc. With a flexible sheet assembly 20 a user can fold it and store it away in toolboxes or other smaller spaces. Magnetic elements 27 are secured to the inner surface of pockets 24. Elements 27 are preferably made out of a flexible magnetic material. Since tools T are typically made out of ferromagnetic material, the elements 27 help keep them in place. Assembly 20 has a loop 28 mounted to back side 22. Belt 23 is passed through loop 28 to support holder 10 around a user's waist. Adjacent to upper edge 25 of sheet 20, rigid elongated member 30 is mounted to back side 22. Member 30 causes upper edge 25 to stay substantially straight permitting sheet assembly 20 to fall perpendicularly down from member 30. Lower belt 32 is sewn into sheet assembly 20 at lower edge 26 to keep it substantially adjacent to a user's leg.

Figure 6:
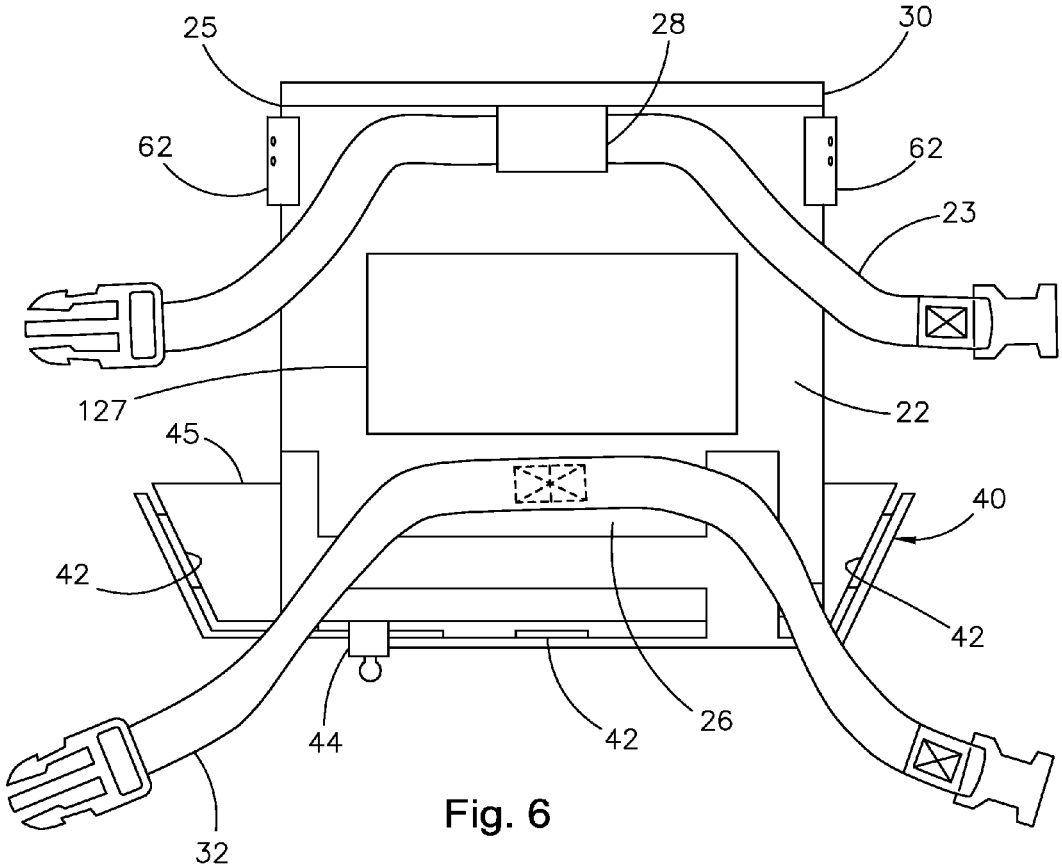
FIG. 6 is the rear elevational view of the preferred embodiment of the present invention.

As seen in FIG. 6, an alternate way of implementing the individual magnetic elements 27 for each pocket is to use one larger magnetic element 127 on the back of sheet assembly 20. Optionally, a large magnetic element 127 can be covered with a cloth (not shown) to prevent discomfort. Large magnetic element 127 needs to have sufficient field strength to attract ferromagnetic tools inside the pockets 24.

Tray holder assembly 40 is made out of relatively rigid material and has an elongated shape defining a concave space for cooperatively receiving a tray 45. Assembly 40 is mounted to sheet assembly 20 adjacent to lower edge 26. Tray 45 and/or assembly 40 can be optionally provided with magnetic elements 42 cooperatively disposed to cause their attraction towards tray 45 for properly lodging tray 45 within assembly 40. If tray 45 is made out of a ferromagnetic material, then magnetic elements 42 only need to be mounted to tray holder assembly 40, and vice versa. Assembly 40 includes a telescopic mechanism 44 for adjusting the length to cooperate with the dimensions of tray 45.

Figure 7:
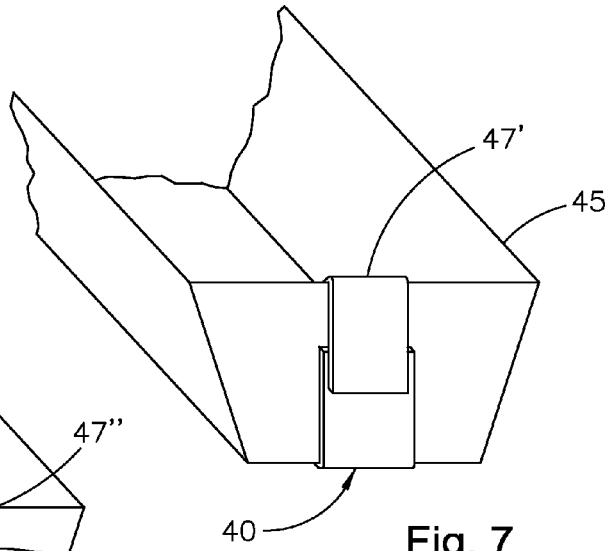
FIG. 7 is an isometric view of an alternate embodiment for securing the tray to the tray holder assembly utilizing a resilient clip.
Figure 8:
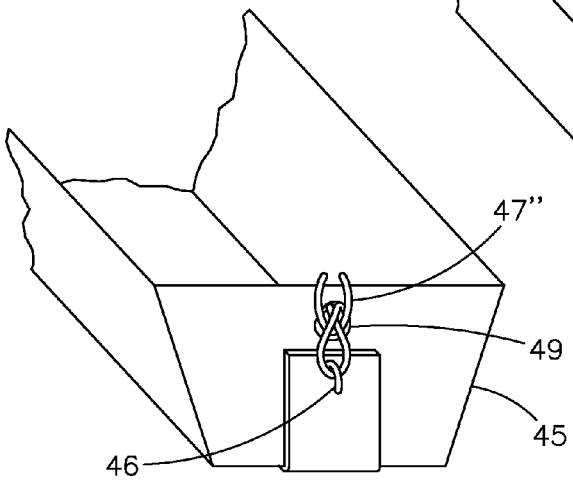
FIG. 8 is an isometric view of another alternate embodiment for securing the tray using a rubber band and headed rivet.
Figure 10:
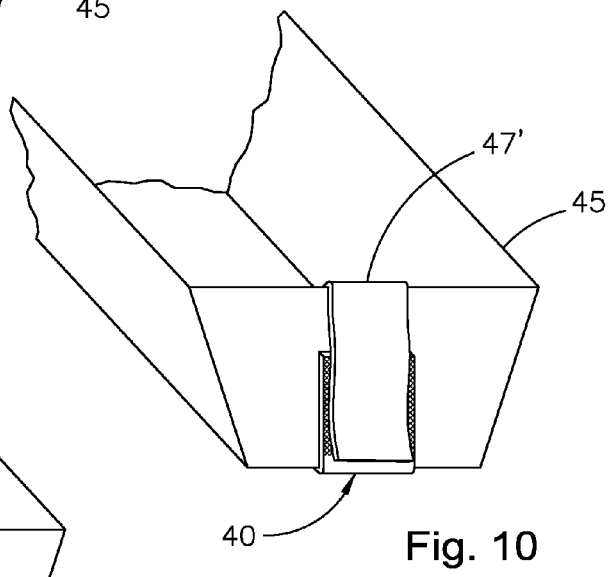
FIG. 10 illustrates the use of a pressure sensitive material for securing the tray to the tray holding assembly.
Figure 9:
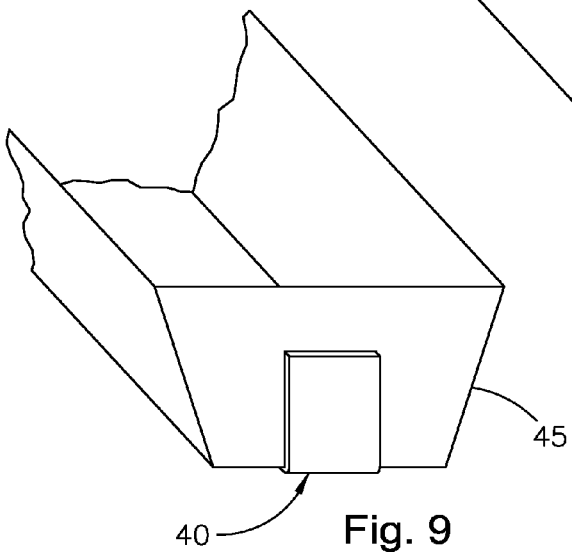
FIG. 9 shows an isometric view of a latch mechanism that can also be used for locking the tray in place.

Optionally, additional locking members 47 can be provided to mechanically secure tray 45 to assembly 40. Member 47 can be implemented as shown in FIGS. 7; 8; 9; and 10, but there are other equivalent alternatives for mechanically and releasably securing tray 45 to assembly 40. In FIG. 7, a resilient clip 47' is inserted sandwiching a wall of tray 45 and a portion of assembly 40. Another way of implementing locking mechanism 47 is to use a rubber band 47" that is passed through an opening 49 in tray assembly 40 and securing it to a headed rivet 46 mounted to a cooperative section of assembly 40, as shown in FIG. 8. Likewise, FIG. 9 shows a latch mechanism that can also be used. Even Velcro strips can also be used to implement this function.

Tray holder supporting assembly 60 provides support to tray holder assembly 40. This permits tray 45 to be supported in a substantially horizontal position convenient for a user to reach the compound placed in tray 45. Cord 64 is removably mounted at one end to member 62, which is permanently mounted to sheet assembly 20. The opposite end of cord 64 is removably mounted to member 66, which is permanently mounted to tray holder assembly 40.

The foregoing description conveys the best understanding of the objectives and advantages of the present invention.

Different embodiments may be made of the inventive concept of this invention. It is to be understood that all matter disclosed herein is to be interpreted merely as illustrative, and not in a limiting sense.

What is claimed is:

1. A holder for compound tray and tools, comprising:

A) a flexible sheet assembly having a front and back sides, upper and lower edges, and two lateral edges and including a rigid longitudinally extending member mounted adjacent to said upper edge and said sheet assembly further including at least one pocket from on said front side;

B) a tray holder assembly mounted adjacent to said lower edge and further including a ferromagnetic tray removably mounted to said tray holder assembly, said tray including a bottom wall with peripheral walls for containing compound matter and said tray holder assembly having a cradle for holding said tray wherein said tray holder assembly and tray include cooperating magnetic elements that urge said tray to come to be housed and supported by said tray holder assembly and a tray holder supporting assembly further including at least one cord with first and second ends, said first end being mounted to a predetermined location on said flexible sheet assembly and said second end being removably mounted to said tray thereby keeping said tray in a substantially horizontal position;

C) said tray holder supporting assembly to hold said tray holder assembly in a substantially horizontal position when said holder is mounted to a user's waist belt; and D) first belt means for supporting said sheet by a user's waist.

2. The holder set forth in claim 1 further including:

E) second belt means for bringing said lower edge adjacent to a user's leg.

3. The holder set forth in claim 2 wherein said at least one pocket is designed to removably receive a plurality of tools including taping knives of different widths.

4. The holder set forth in claim 3 wherein said sheet assembly includes first and second elongated reinforcements mounted to said upper and lower edges, respectively, so that support is provided to said tray holder assembly by said second elongated reinforcement so that sufficient gravitational force urges said sheet assembly to a suspended and stretched state in a substantially vertical position but still permitting said sheet assembly to flex along the lateral edges where there are no reinforcement members thereby minimizing obstruction to a user's movements.

5. The holder set forth in claim 4 further including:

F) mechanical locking means for removably securing said tray to said tray holder assembly.

6. The holder set forth in claim 5 wherein said mechanical locking means include a resilient clip member with cooperative dimensions to snuggly sandwich said tray and a portion of said peripheral walls.

7. The holder set forth in claim 6 wherein said tray holder assembly is longitudinally adjustable.

8. The holder set forth in claim 1 wherein said at least one pocket includes a magnetic element inside for urging a ferromagnetic tool to stay inside said at least one pocket.

9. The holder set forth in claim 8 further including:

E) second belt means for bringing said lower edge adjacent to a user's leg.

10. The holder set forth in claim 9 wherein said at least one pocket is designed to removably receive a plurality of tools including taping knives of different widths.

11. The holder set forth in claim 10 wherein said sheet assembly includes first and second elongated reinforcements mounted to said upper and lower edges, respectively, so that support is provided to said tray holder assembly by said second elongated reinforcement so that sufficient gravitational force urges said sheet assembly to a suspended and stretched state in a substantially vertical position but still permitting said sheet assembly to flex along the lateral edges where there are no reinforcement members thereby minimizing obstruction to a user's movements.

12. The holder set forth in claim 11 further including:

F) mechanical locking means for removably securing said tray to said tray holder assembly.

13. The holder set forth in claim 12 wherein said mechanical locking means include a resilient clip member with cooperative dimensions to snuggly sandwich said tray and a portion of said peripheral walls.

14. The holder set forth in claim 13 wherein said tray holder assembly is longitudinally adjustable.

* * * * *